United States Patent [19]

Cross

[11] Patent Number: 4,523,399

[45] Date of Patent: Jun. 18, 1985

[54] DISPLAY MOUNT APPARATUS AND METHOD

[76] Inventor: Carroll N. Cross, Rte. 2, Box 741, Maitland, Fla. 32751

[21] Appl. No.: 563,625

[22] Filed: Dec. 20, 1983

[51] Int. Cl.[3] ..... G09D 3/00

[52] U.S. Cl. ..... 40/119; 40/107; 40/110; 40/120

[58] Field of Search ..... 40/107, 110, 119, 120, 40/121, 122; 100/33 PB

[56] References Cited

U.S. PATENT DOCUMENTS 1,524,164 1/1925 Bennet ..... 40/110
3,002,307 10/1961 Cross ..... 40/120

FOREIGN PATENT DOCUMENTS 386737 7/1965 Switzerland ..... 40/110

*Primary Examiner*—Gene Mancene
*Assistant Examiner*—Cary E. Stone
*Attorney, Agent, or Firm*—William M. Hobby, III

[57] ABSTRACT

A display mount apparatus has a mounting board of predetermined width and a pad of sheet material having a predetermined width less than the predetermined width of the mounting board. A polymer binding extends around the mounting board and around all or a portion of the pad of sheet material to support the pad or sheet material to the mounting board. The polymer binding has a slight resiliency and may have imprinting thereon to indicate a day on a calendar, or the like. The method of making a display mount includes the steps of selecting a mounting board of predetermined width and a pad of sheet material of a predetermined width less than the width of the mounting board, binding the pad to the mounting board with a polymer strip extending around the mounting board and around at least a part of the sheets of the pad of sheet material. An additional step includes foil stamping polymer banding material prior to binding the mounting board and pad together and may include the steps of opening pages on the pad of sheet material during binding and folding the sheets back over the band to support the pad or sheet material to the mounting board.

7 Claims, 13 Drawing Figures

DISPLAY MOUNT APPARATUS AND METHOD

BACKGROUND OF THE INVENTION

The present invention relates to a display mount apparatus and a method of making a display mount apparatus using a web of polymer binding material around a mounting board and calendar pad or the like, which polymer material may be transparent and have imprinting thereon.

A wide variety of display mounts for displaying calendars and the like have been provided through sales to the public and through various companies as part of the company's advertising. Typically, these display mounts are made of paperboard, metal, or plastic, which has a plurality of calendar leaves attached thereto by staples, stitches, polymer tape, or are placed in pockets on the display mount. The display may be provided with some means for supporting the display, such as having a rear hinged panel and a tongue connecting one panel to the other to hold the panels in position. These prior type displays are frequently provided free by companies to their customers and potential customers with their advertising material printed on the display mount.

The present invention is directed towards a calendar display which may contain conventional advertising material thereon, but which may have a calendar pad mounted with a slim polymer banding strip therearound to support the calendar to the display pad and also to a slim transparent polymer bands having imprinting thereon, which may be moved to indicate days on the calendar.

Typical display mounts for calendar pads and the like may be seen in my prior U.S. Pat. No. 2,355,706 for a display mount having a well in the face thereof for displaying material such as calendar pads and in U.S. Pat. Nos. 3,058,410 and 3,079,715 for an improved display mount structure and improved method for forming the display windows and display wells and display mount structures. In addition, my prior patents on display and photo mounts can be seen in U.S. Pat. No. 3,216,582; U.S. Pat. No. 3,068,139; and U.S. Pat. No. 3,002,720, which includes my patent on an aluminum hinge which allows a supporting prop or other display mount supports to be mounted with a flexible hinged panel which stays in place without the use of interconnecting tongues. Additional display mounts may be seen in my prior U.S. Pat. No. 4,285,683 for a method of making a display mount; U.S. Pat. No. 4,199,883 for a display mount; U.S. Pat. No. 4,326,906 for a display mount and method; U.S. Pat. No. 4,263,733 for a display mount with protected thermometer; U.S. Pat. No. 4,299,643 for a method of making a hinged display mount; U.S. Pat. No. 4,288,935 for a display book apparatus; and in U.S. Pat. No. 4,351,123 for a display mount and method.

The present invention has the aim of an improved method for making a display mount without using the common stapling of a calendar pad to the display mount by the use of a slightly resilient transparent polymer band tightly binding the display mount and some of the pages of the calendar pad, or alternatively, loosely binding the calendar pad and display mount with a band having imprinting thereon allowing the band to slide for marking positions on the display calendar. This binding is especially useful in calendar page binding where the back panel can be preprinted with an ad of the advertiser, placing most pages at a point below the bottom edge of the band location and at least one page under and above the top edge of the narrow binding and then binding the calendar pad to the back panel. If the binding is attached before insertion of the gummed edge calendar pad, the top page or pages of the calendar pad are above the top edge of the band binding and the other pages under the binding, so that when the top pages are folded over the other pages the edge of the bound edge pages coincide with the top edge of the binding, thus securely holding the underlying and top page of the calendar pad in position with the top page being outside the binding for complete viewing of all printed indicia on this page and permitting writing on the entire front surface of the exposed top page. Thus there are no exposed staples, as with most calendars, and backing where they are stapled to the backing and where each month page when removed is discarded. This binding with a calendar pad is substantially as fast as stapling a calendar pad to a backing board.

SUMMARY OF THE INVENTION

A display mount apparatus is provided in which a mounting board of a predetermined width has a pad of sheet material of predetermined width less than the predetermined width of the mounting board mounted thereto with a transparent polymer band extending around the mounting board and around at least a portion of the pad of sheet material to support the pad of sheet material to the mounting board. The polymer band may be mounted around some of the pages of the pad of sheet material at the spine or fold line of the pages with the other pages extending over the band to support the calendar to the mounting board. The band of binding material may also be more loosely mounted around the mounting board and pad of sheet material and have imprinting thereon so as to be slidable for lining the imprinting up with predetermined positions, such as to indicate the date on a calendar.

The method of making a display mount includes the step of selecting a mounting board of predetermined width and selecting a pad of sheet material, such as a calendar, and having a predetermined width less than the predetermined width of the mounting board. The next step is the binding of the selected pad of sheet material to the selected mounting board with a polymer binding strip extending around the mounting board and around at least a portion of the pages of the pad of sheet material. The process may include the imprinting or foil stamping of material, such as a circle or logo, on the binding strip prior to binding the pad of sheet material and mounting board. The binding operation includes the cutting and welding of a strip of polymer binding material around the mounting board pad under preset tension. A machine for performing the method includes a banding machine having a frame mounted thereon with a foil stamper mechanism mounted to the top of the banding machine and positioning a reel of polymer banding material on one side of the foil stamper so that the material can be fed through the foil stamper and into the banding machine so the foil stamping can be done at predetermined positions on the banding strip.

BRIEF DESCRIPTION OF THE DRAWINGS

Other objects, features and advantages of the present invention will be apparent from the written description and the drawings, in which.

DESCRIPTION OF THE PREFERRED EMBODIMENTS

Figure 1:
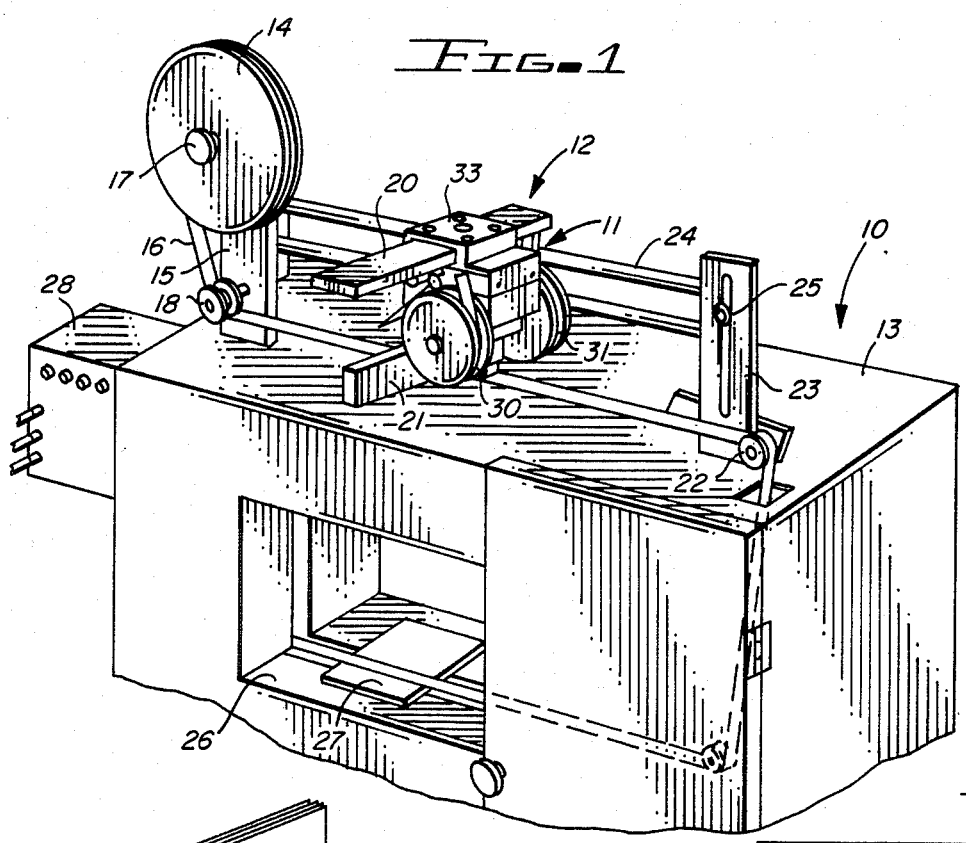
FIG. 1 shows a perspective view of a banding machine adapted to foil stamp the polymer binding material.
Figure 2:
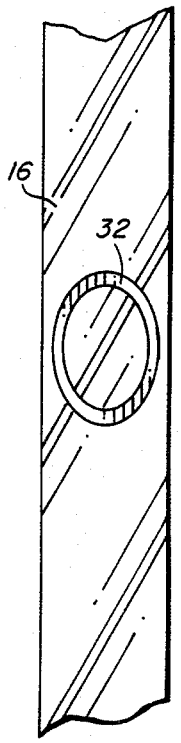
FIG. 2 is a side elevation of a polymer banding strip having a foil stamped oval thereon.

Referring to the drawings and especially to FIG. 1, a banding machine 10 is illustrated having a foil stamping machine 11 mounted to the top thereof on a frame 12. The banding machine has a housing 13 with a supply reel 14 mounted to a reel support frame 15 thereon and has polymer banding material 16 being fed from the reel. The reel of polymer banding material can be quickly replaced by rotating the handle 17 to remove the reel shaft from the frame 15. The web of banding material is fed past a roller 18, supported on the frame 15, between the frame members 20 and 21 of the frame 12, and through the foil stamping mechanism 11, over a pulley 22, attached to the frame member 23. Frame member 23 has adjustable frame bars 24 adjustable on the slot 25 on one end and adjustable on the frame 15 on the other end thereof. The banding web 16 is fed over the roller 22 into the banding machine and into the banding work surface 26 where individual calendar pads can be banded to calendar mount 27. The banding machine 13 also has a control panel 28, which can adjust the tension of the band wrapped around the calendar's mount. The foil stamping feed reel 30 feeds a polymer material coated with a colored foil and a take-up reel 31 for receiving the feed material after the stamping operation. The stamping operation includes an anvil for supporting the banding material 16 in a hot stamping press cyclicly fed to push the foil stamping material being fed from roll 30 against the banding material 16 with a hot die to imprint an image thereon, such as the oval window 32 on the banding material 16 of FIG. 2. The banding material is a transparent polymer material which may have a slight resiliency. The foil stamping machine 12 includes a casing 33 which houses the heating elements as well as the solenoid or other drive for driving the dies against the foil stamping material. A conventional commercial foil stamping machine is utilized, as is a commercially purchased banding machine 13. The machines are adapted to work together by the positioning of the feed reel 14 and by the mounting of the frame 12 and positioning of the anvil and die of the foil stamping machine 12 relative to the banding material 16 being fed thereby.

Figure 3:
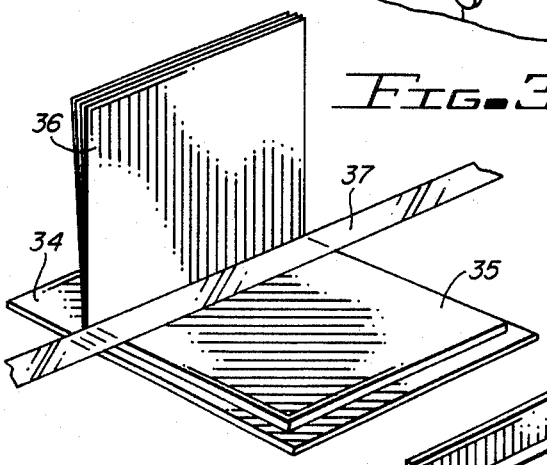
FIG. 3 is a perspective view of a calendar pad being banded to a display mounting board.

Turning to FIG. 3, a mounting board 34 has a pad having pages of sheet material 35 positioned thereon and having a width smaller than the width of the mounting board 34. Part of the pages 36 have been opened for the banding strip 37 to be bound thereover on the surface 26 of the banding machine 10.

Figure 4:
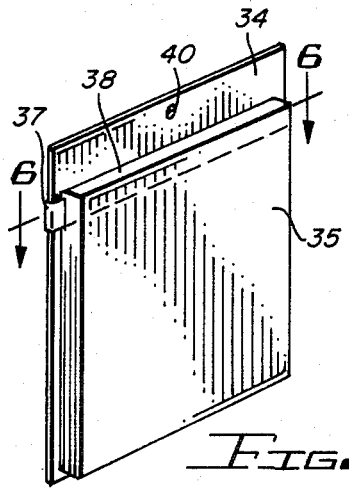
FIG. 4 is a perspective view of a display mount having the calendar pad banded to the mounting board.

FIG. 4 shows the completion of the banding operation with the band 37 supporting the calendar pad 35 at the spine or fold line 38 of the calendar pad 35. The mounting board 34 may be casebound and may have an aperture 40 therethrough for supporting the calendar on a wall.

Figure 5:
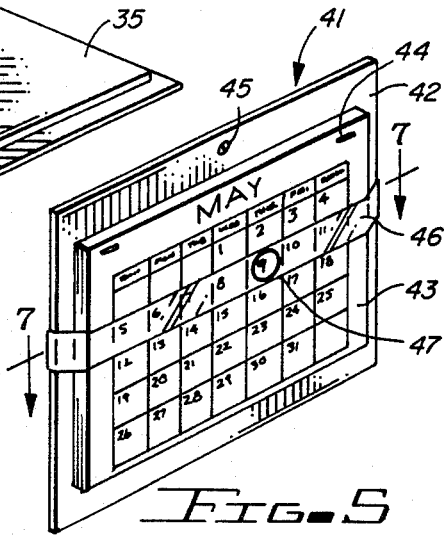
FIG. 5 is a perspective view of a banded display mount and calendar pad having imprinting on the polymer band.

FIG. 5 shows an alternate embodiment of a calendar display mount 41 having a mounting board 42 with a calendar 43 mounted thereto with staples 44 in a conventional manner. The mounting pad 42 has an aperture 45 therethrough and a transparent polymer banding strip 46 bound therearound. In should be noted that the calendar pad 43 has a width less than the mounting board 42, and in this case, the transparent polymer strip 46 is more loosely bound so that it can be slid around over the calendar pad 43 and has a foil stamped circle 47 imprinted thereon so that sliding the band 46 with the circle 47 over one day of the month will indicate readily the date. The banding strip 46 is sufficiently tightly bound as to hold its position, but less tightly bound as the band 37 of FIG. 4, which would be difficult to move the banding strip because of the tightness of the banding.

Figure 6:
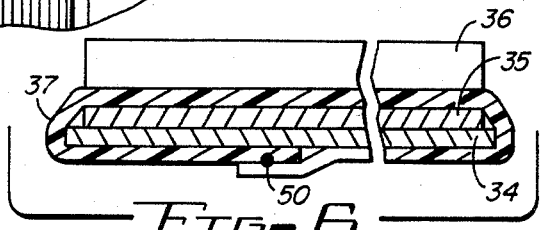
FIG. 6 is a sectional view taken on the line 6—6 of FIG. 4.

FIG. 6 shows a polymer banding strip 37 banded around the mounting board 34 and calendar pad 35 with the pages 36 protruding over the banding 37 and the banding material overlapping and having a heat weld 50 on the back thereof. It should be noted that the width of the calendar pad is less than the width f the mounting board, which is required to securely mount the calendar to the board by gripping the edges of the board.

Figure 7:
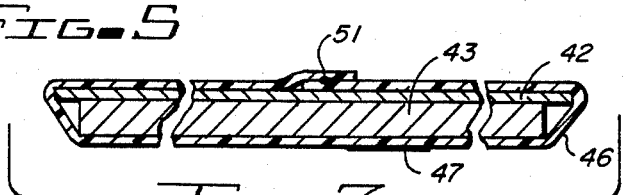
FIG. 7 is a sectional view taken on the line 7—7 of FIG. 5.

FIG. 7 is a sectional view showing the banding strip 46 having the foil stamp portion 47 thereon and extending around the mounting board 42 and the calendar pad 43 and overlapping with a heat weld 51 on the back thereof.

Figure 8:
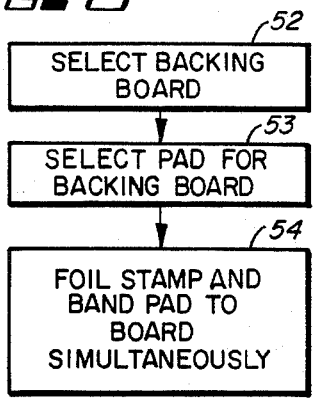
FIG. 8 is a flow diagram of a process of making a display mount in accordance with the present invention.

Turning to FIG. 8, a flow diagram of the process in accordance with the present invention is illustrated having the steps of selecting a backing board 52, then selecting a pad for the backing board 53, which pad of sheet material is of a predetermined width narrower than the width of the selected backing board. Foil stamping of a polymer web 54 is next performed in the banding machine of FIG. 1 to band the pad to the board with a web. The process includes selecting the proper banding material with sufficient resilience for supporting a calendar pad to a mounting board when tightly bound or to allow the movement of the band when loosely bound. The transparent polymer band may be made of any polymer material with fast acting heating sealability. This process also contemplates the step of opening the calendar pad on it's hinged spine, positioning the calendar pad on the mounting board in the banding machine window 26, banding the calendar pad inside pages adjacent the spine and then folding the pages on the spine over the banding material. The foil stamping of the band is not essential to the binding operation, but is included in this embodiment.

The binding band is resilient and the tension in banding is variable and permits the band to be attached around a backing panel having substantially parallel sides. Folded pages or a gummed edge calendar pad may be inserted with one or more pages under the pad and one or more pages outside the band. The pages are then slid so that the spine or folded page line is adjacent the band, which is at a right angle to the sides of the backing board. Folding the top pages over the band brings the pages in alignment and parallel to the side edges of the backing board.

Figure 9:
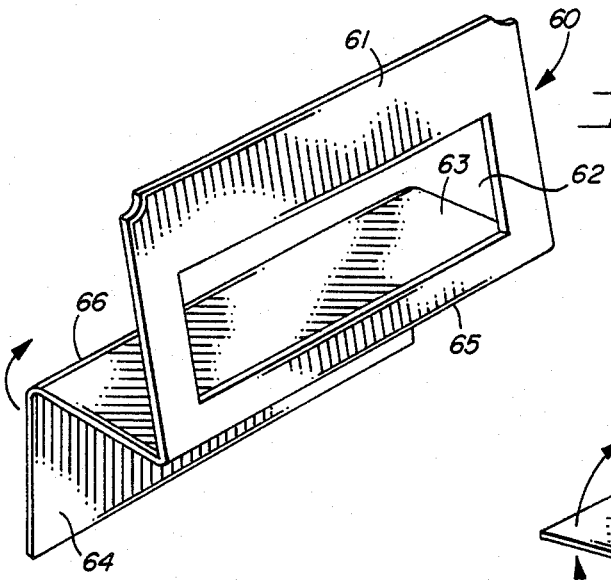
FIG. 9 is a perspective view of a portion of a display mount.
Figure 10:
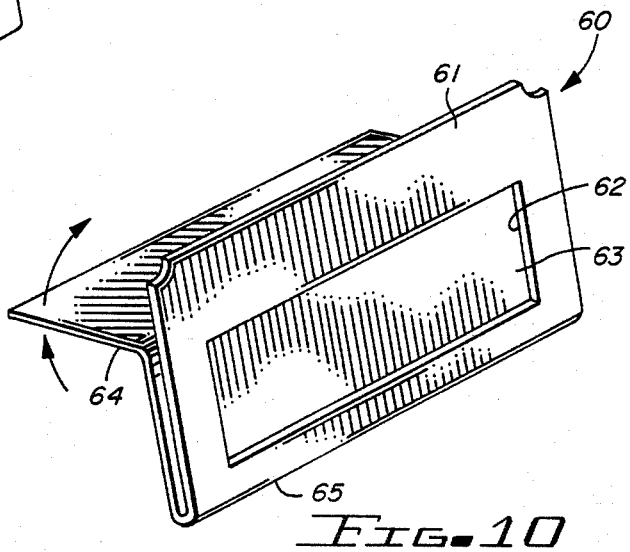
FIG. 10 is a perspective view of a display mount of FIG. 9 being folded.
Figure 11:
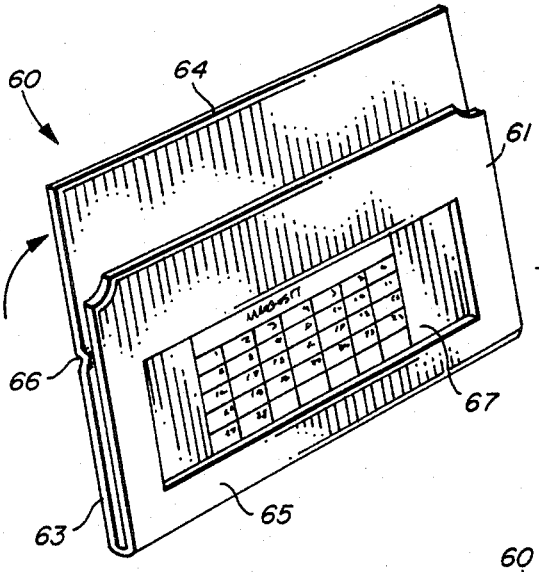
FIG. 11 is a perspective view of the display mount of FIGS. 9 and 10 having a calendar therein and folded flat.

Turning now to FIGS. 9 through 13, an alternate embodiment of the apparatus and method of making a display mount is illustrated in which FIG. 9 has a first mounting board 60 which has been diecut to a predetermined size and shape and has a diecut opening 62 through a front panel 61 and is hinged to a second panel 63 at the hinged area 65. Panel 63, in turn, is hinged at 66 to a third panel 64. The panels, of course, are diecut in a flat position and are being folded, as shown in FIG. 9. In FIG. 10, the diecut panel 60 has been further folded to bring the panel 63 adjacent the panel 61 and in FIG. 11, the panel 64 has been further folded so that panel 61 is parallel to panel 63 and 64 and a calendar pad 67 has been inserted in the window 63.

Figure 12:
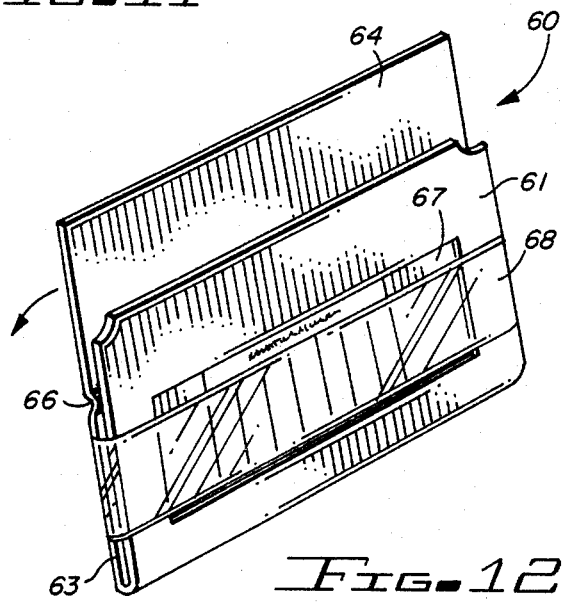
FIG. 12 is the display mount of FIGS. 9 through 11 with a banded binding.

In FIG. 12, a transparent polymer binding 68 has been banded around panel 61 and 63 and around the calendar pad 67 located in the window 62. The binding 68 is attached to form a continuous loop band therearound, which holds the panels 63 and 61 bound together with the calendar pad 67 mounted therein. The display mount 60 can be shipped as shown in FIG. 12 and set up as shown in FIG. 13, in which the panel 64 has been folded on the hinged area 66.

Figure 13:
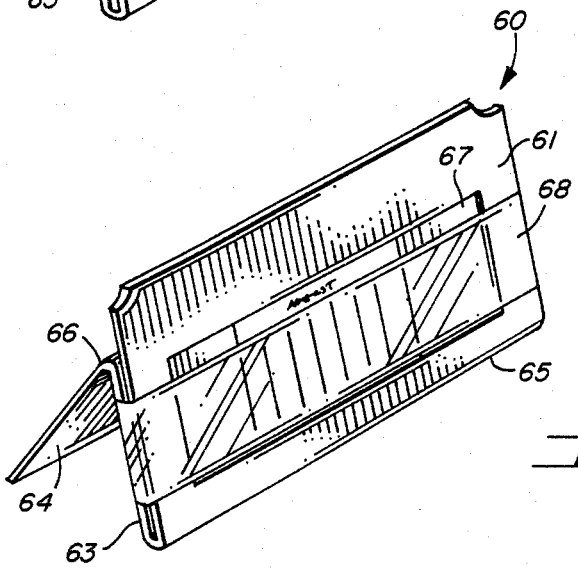
FIG. 13 is a perspective view of fully assembled display mount of FIGS. 9 through 12.

The steps and the process of FIGS. 9 through 13 can be seen as including the diecutting of a panel of a predetermined shape and diecutting a window in one of the hinged panels folding the hinge panels on one hinge to provide a face panel 61 parallel to hinge panels 63 and 64, inserting a calendar mount, binding the panels 61 and 63 together while binding the calendar pad in the diecut window opening 62. The final step, as shown in FIG. 13, of folding the panel 64 on the hinge area 66 would normally be performed by the ultimate consumer in setting up the display mount.

It should be clear at this point that a banding foil and printing machine has been provided along with a display mount and a process of making a display mount. To avoid any relative loose binding sliding up or down along the two sides edges, there can be slots on either side to position the width of the binding or a wider base so that a wall calendar will not have displacement of the bound monthly pages. However, the present invention is not to be construed as limited to the forms shown, which are considered to be illustrative rather than restrictive.

I claim:

1. A method of making a display mount comprising the steps of:

selecting a mounting board of predetermined width;

selecting a pad of sheet material for said mounting board having a predetermined width less than said mounting board;

positioning the selected pad of sheet material on the selected mounting board with at least one page of said pad of sheet material open;

binding said pad of sheet material to said mounting board with a polymer strip extending around said mounting board and around a portion of the pages of said pad of sheet material; and folding each said open sheet over said polymer strip binding the remaining sheets to the mounting board.

2. A method in accordance with claim 1, including the step of imprinting said polymer binding strip prior to binding said mounting board and pad of sheet material together.

3. A method in accordance with claim 2, in which said imprinting includes foil stamping a transparent polymer binding material.

4. A method in accordance with claim 1, in which said binding step includes heat sealing two ends of binding material together on one side of said mounting board.

5. A method in accordance with claim 1, including the step of folding a pair of panels parallel to each other and binding around both panels.

6. A method in accordance with claim 5, including the step of folding a third panel on a hinge to act as a display mount support.

7. A method in accordance with claim 6, including the step of diecutting an opening in one said panel prior to folding said panels and inserting a pad of sheet material therein and then banding said parallel panels together with said pad of sheet material.

* * * * *